US006188168B1

(12) United States Patent
Han et al.

(10) Patent No.: US 6,188,168 B1
(45) Date of Patent: Feb. 13, 2001

(54) LAMINATED SPRING STRUCTURE FOR CRT

(75) Inventors: Dong-hee Han; Sung-hwan Moon, both of Kyungki-do; Seung-kwon Han, Seoul, all of (KR)

(73) Assignee: Samsung Display Devices Co., Ltd., Kyungki-do (KR)

( * ) Notice: Under 35 U.S.C. 154(b), the term of this patent shall be extended for 0 days.

(21) Appl. No.: 09/179,510

(22) Filed: Oct. 27, 1998

(30) Foreign Application Priority Data

Dec. 1, 1997 (KR) ..... 97-65014

(51) Int. Cl.[7] ..... H01J 29/80
(52) U.S. Cl. ..... 313/405; 313/402; 313/404
(58) Field of Search ..... 313/402, 404, 313/405, 406, 407

(56) References Cited

U.S. PATENT DOCUMENTS 4,506,188 * 3/1985 Puhak ..... 313/405
4,613,785 * 9/1986 Ragland ..... 313/405

* cited by examiner

*Primary Examiner*—Vip Patel
(74) *Attorney, Agent, or Firm*—Christie, Parker & Hale, LLP

(57) ABSTRACT

A spring used in a CRT interconnects a stud pin embedded into a CRT panel and a mask frame mounting a shadow mask thereon so that the spring removably mounts the shadow mask within the CRT panel. In order to minimize or interrupt a vibration energy transmitted to the shadow mask, the spring is formed with a composite metal plate having a laminated structure of more than two materials capable of converting the vibration energy applied thereto into a thermal energy by an internal or interfacial friction. The composite metal plate is preferably composed of a first steel, a zinc alloy, and a second steel. A method of making the spring includes the steps of plating two or more metallic materials in sequence, rolling the plated metallic materials into an integrated composite metal plate, and forming the composite metal plate into a spring shape.

4 Claims, 2 Drawing Sheets

FIG.1
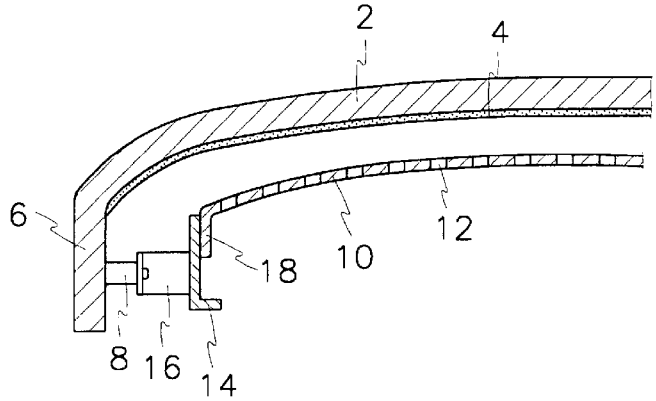
FIG.2
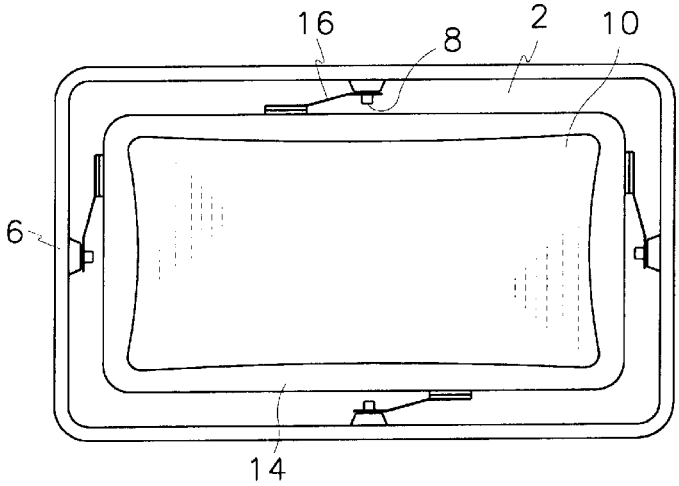
FIG.3A
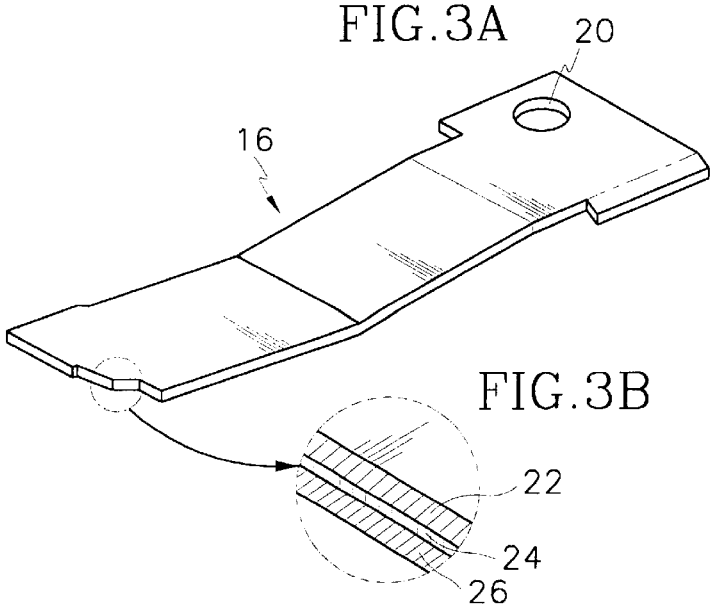
FIG.3B

LAMINATED SPRING STRUCTURE FOR CRT

REFERENCE TO RELATED APPLICATION

This application is based on application No. 97-65014 filed in Korean Industrial Property Office on Dec. 1, 1997, the content of which is incorporated hereinto by reference.

FIELD OF THE INVENTION

The present invention relates to a spring for a cathode ray tube (CRT) and, more particularly, to a spring for mounting a shadow mask within a CRT panel while extinguishing the vibration energy transmitted thereto.

BACKGROUND OF THE INVENTION

In general, CRTs are designed to display colored images on a panel screen by exciting phosphors on the internal surface of the screen with electron beams emitted from an electron gun while varying the intensity of phosphor-excitation. A thin-metal shadow mask having a plurality of apertures is placed directly behind the screen to ensure that each beam hits the corresponding phosphor. That is, the shadow mask may act as a color selector to minimize the generation of spurious colors due to excitation of the wrong phosphor.

The shadow mask is mounted in the CRT panel with a support assembly. The support assembly includes a mask frame placed under the shadow mask to support it and a plurality of stud pins each embedded in the panel with a protruding portion. The support assembly further includes a plurality of springs for connecting the mask frame to the stud pins. Each of the springs has an end welded to the mask frame and an opposite end engaged with the protruding portion of the stud pin.

The spring is conventionally formed with a metal plate consisting of one element. However, with this structure, when external impacts or sonic waves from a Speaker are applied to the CRT, the resulting vibration energy is easily transmitted to the shadow mask sequentially through the stud pin and the spring. At this time, the shadow mask seriously vibrates due to its structural weakness so that the electron beam deviates from its correct progressing course and impinges upon wrong phosphors, causing spurious color images on the viewing screen.

Therefore, it is necessary that the spring should act as a connecting medium capable of minimizing or interrupting the vibration energy from the external.

SUMMARY OF THE INVENTION

It is an object of the present invention to provide a spring for mounting a shadow mask assembly within a CRT panel with an improved vibration prevention characteristic.

In order to achieve this object, the spring is formed with a composite metal plate having a laminated structure of more than two materials capable of converting the vibration energy applied thereto into a thermal energy by an internal or interfacial friction.

A method of making the spring includes the steps of plating two or more metallic materials in sequence, rolling the plated metallic materials into an integrated composite metal plate, and forming the composite metal plate into a spring shape.

The composite metal plate is composed of a first steel, a zinc alloy, and a second steel to convert the vibration energy applied thereto into the thermal energy by the internal friction of the zinc alloy and interfacial friction between the steel and the zinc alloy, resulting in an efficient vibration offsetting effect.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or the similar components, wherein:

FIG. 1 is a fragmentary sectional view showing a front panel portion of a CRT with a spring according to a preferred embodiment of the present invention;

FIG. 2 is a rear view of the front panel portion of the CRT according to the preferred embodiment;

FIGS. 3A–3B is a perspective view showing a spring according to the preferred embodiment.

DETAILED DESCRIPTION OF THE PREFERRED EMBODIMENTS

Figure 4:
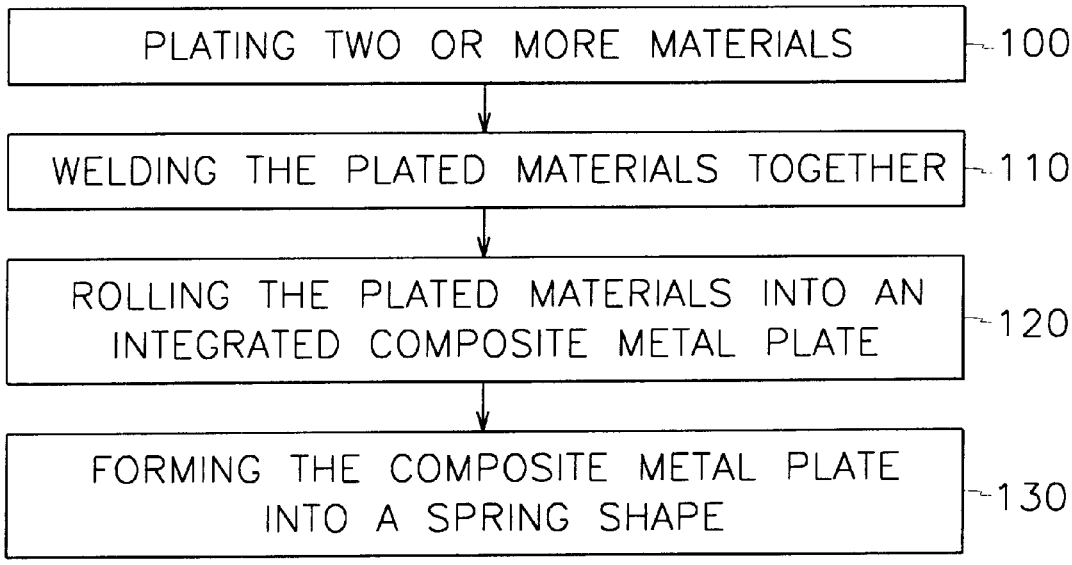
FIG. 4 is a flow chart illustrating a process of making the spring according to the preferred embodiment.

A preferred embodiment of this invention will be explained with reference to the accompanying drawings.

FIG. 1 is a fragmentary sectional view showing a front panel portion of a CRT. As shown in FIG. 1, the CRT includes a front panel 2 having an inner phosphor screen 4 and a side-wall 6, a stud pin 8 embedded into the side-wall 6, and a shadow mask 10 placed behind the phosphor screen 4 at a predeterminate distance. The shadow mask 10 is provided with a masking portion 12 having a plurality of beam-guide apertures and a skirt portion 18 bent from the masking portion 12.

The skirt portion 18 of the shadow mask 10 is welded to a mask frame 14. The mask frame 14 is connected to the stud pin 8 by inserting a spring 16 therebetween. In this way, the shadow mask 10 is suspended in the panel 2.

As shown in FIG. 2, there are usually provided four springs 16 on each side of the mask frame 14 and each of the springs 16 has an end welded to the mask frame 14. Meanwhile, the spring 16 has an opposing end with an engaging opening 20 as shown in FIG. 3. The engaging opening 20 is removably connected to the stud pin 8.

When a vibration energy such as sonic waves from a speaker or external impacts is applied to the CRT, the vibration energy passes sequentially through the panel 2, the stud pin 8, the spring 16, and the mask frame 14 to the shadow mask 10.

In order to minimize the vibration energy transmitted to the shadow mask 10, the spring 16 has a laminated structure with at least two different materials.

As shown in the enlarged circle of FIG. 3, the spring 16 is formed with a composite metal plate consisting of a first steel 22, a zinc alloy 24, and a second steel 26. The three components are sandwiched and laminated to form the composite metal plate.

Accordingly, the vibration energy transmitted through the stud pin to the spring 16 exerts an interfacial friction between the steels 22 and 26 and the zinc alloy 24. The interfacial friction is converted into a thermal energy to be externally diffused.

The zinc alloy 24 is formed with an aluminum-zinc based alloy comprising 20–24% of aluminum. The aluminum-zinc based alloy is preferably formed with an eutectoid structure where the aluminum and zinc components are separately formed.

The zinc alloy 24 generally has a good vibration prevention effect when compared to other metal alloys. Particularly, with the zinc alloy having an eutectoid structure, it is easy to generate the internal friction to convert the vibration energy into the thermal energy. Furthermore, with the eutectoid structure, the melting point of the zinc alloy becomes lower and, hence, is well adapted for any thermal treatment, even above 120° C., including an annealing process. Therefore, the zinc alloy 24 can be effectively employed for the CRT spring use.

A method of making a spring for a CRT will be now described with reference to FIG. 4.

As shown in FIG. 4, the spring making method includes a plating step 100 for plating two or more materials together, a rolling step 120 for rolling the plated materials into an integrated composite metal plate, and a forming step 130 for forming the composite metal plate into a spring shape.

The plating step 100 is performed by sequentially overlaying a first steel, a zinc alloy, and a second steel.

In an alternative embodiment, a welding step 110 may be additionally performed with respect to the plated materials. This additional step is selectively added to the normal spring making process to secure adherence and prevent slippage between the steel and the zinc alloy. In the welding step 110, the plated materials are partly welded together one time or more. Specifically, the welding operation is performed along the periphery of the plated materials.

The rolling step 120 is then performed under the atmosphere of argon, at high temperatures in the range of 200–240° C. In the rolling step 120, the plated materials pass through a pair of rollers to be thereby rolled into an integrated composite metal plate. The argon gas prevents oxidization of the steel during the rolling operation.

At this time, the thickness of the integrated composite metal plate is reduced by 25% compared to that of the plated materials.

Finally, the forming step 130 is performed with respect to the integrated composite metal plate. In this step, the composite metal plate is cut and bent into a spring shape. This forming step 130 is carried out as in the conventional spring formation process.

With this structure, the spring according to the present invention can minimize vibration of the shadow mask due to the elements by converting the vibration energy into the thermal energy and externally exhausting it. Therefore, the picture quality can be largely improved by the use of the invented spring.

While the present invention has been described in detail with reference to the preferred embodiments, those skilled in the art will appreciate that various modifications and substitutions can be made thereto without departing from the spirit and scope of the present invention as set forth in the appended claims.

What is claimed is:

1. A spring for interconnecting a shadow mask assembly comprising a shadow mask mounted to a shadow mask frame to a stud pin of a cathode ray tube, the spring comprising:

a composite metal plate having a laminated structure to convert a vibration energy applied thereto into a thermal energy by internal or interfacial friction, the composite metal plate comprising a sequentially plated first steel, zinc alloy, and second steel.

2. The spring according to claim 1 wherein the zinc alloy comprises 20–24% aluminum.

3. The spring according to claim 1 wherein the zinc alloy has an eutectoid structure.

4. A cathode ray tube, comprising:

a front panel having a stud pin;

a shadow mask assembly having a shadow mask and a mask frame, said shadow mask being mounted to the shadow mask frame; and a spring interconnecting the shadow mask assembly to the stud pin, said spring comprising a composite metal plate having a laminated structure including a zinc alloy between two steel layers.

* * * * *